US009126453B2

(12) United States Patent
Takashima et al.

(10) Patent No.: US 9,126,453 B2
(45) Date of Patent: Sep. 8, 2015

(54) WRISTBAND

(75) Inventors: Tetsuya Takashima, Tokyo (JP); Satoru Honda, Tokyo (JP); Isao Watanabe, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 53 days.

(21) Appl. No.: 13/819,482

(22) PCT Filed: Apr. 6, 2011

(86) PCT No.: PCT/JP2011/002031

§ 371 (c)(1),
(2), (4) Date: Feb. 27, 2013

(87) PCT Pub. No.: WO2012/032685

PCT Pub. Date: Mar. 15, 2012

(65) Prior Publication Data

US 2013/0161937 A1 Jun. 27, 2013

(30) Foreign Application Priority Data

Sep. 10, 2010 (JP) ..... 2010-202966

(51) Int. Cl.

| | |
|---|---|
| ***B42D 25/00*** | (2014.01) |
| ***A44C 5/00*** | (2006.01) |
| ***G09F 3/00*** | (2006.01) |

(52) U.S. Cl.

CPC ..... *B42D 25/00* (2014.10); *A44C 5/0015* (2013.01); *G09F 3/005* (2013.01)

(58) Field of Classification Search

USPC ..... 283/75; 40/633

See application file for complete search history.

(56) References Cited

U.S. PATENT DOCUMENTS

| | | | | |
|---|---|---|---|---|
| 2007/0157498 | A1* | 7/2007 | Ali et al. | 40/633 |
| 2010/0058636 | A1* | 3/2010 | Kerlin | 40/633 |
| 2011/0131854 | A1* | 6/2011 | Waltersdorf | 40/633 |

FOREIGN PATENT DOCUMENTS

| | | |
|---|---|---|
| CN | 100527190 C | 8/2009 |
| JP | 2005-215470 | 8/2005 |
| JP | 2005-234497 | 9/2005 |
| JP | 2007-229000 | 9/2007 |
| JP | 2008-500872 | 1/2008 |

OTHER PUBLICATIONS

Search Report completed Jan. 26, 2014 in counterpart Chinese Application No. 201180043555.9 and English translation thereof.

(Continued)

*Primary Examiner* — Kyle Grabowski

(74) *Attorney, Agent, or Firm* — Ostrolenk Faber LLP

(57) ABSTRACT

In a wristbhaving a label-like structure, fracturing notches for preventing unauthorized use are positioned where the two ends of the band are to be glued together. If temporary peeling of the glued ends is attempted, the wristband breaks reliably and it is difficult to return it to the original state. If fracturing notches (11) are formed on either a first winding region (6) or a second winding region (7), which are positioned at left and right ends of the printing region (5). The wristband is configured so that a ring shape can be formed by overlapping and adhering the adhesive layer on the rear surface of one of shape, the first winding region (6) or the second winding region (7) onto the other winding region. An adhesion position check mark (15, 16) is formed on either the first winding region (6) or the second winding region (7).

8 Claims, 5 Drawing Sheets

(56) References Cited

OTHER PUBLICATIONS

First Office Action mailed Feb. 8, 2014 in counterpart Chinese Application No. 201180043555.9 and English translation thereof.

International Search Report dated May 10, 2011 issued in corresponding International Patent Application No. PCT/JP2011/002031.

European Search Report mailed Jan. 3, 2014 in counterpart European Application No. 11823170.3.

* cited by examiner

WRISTBAND

CROSS-REFERENCE TO RELATED APPLICATIONS

The present application is a 35 U.S.C. §§371 national phase conversion of PCT/JP2011/002031, filed Apr. 10, 2011, which claims priority of Japanese Application No. 2010-202966, filed Sep. 10, 2010, the contents of which are incorporated by reference herein. The PCT International Application was published in the Japanese language.

TECHNICAL FIELD

The present invention relates to a wristband, in particular, a wristband for identifying a person by winding it around his/her wrist or ankle. The wristband is, for example, for a patient in a medical field or a visitor in an amusement center.

BACKGROUND ART

Conventionally, a wristband is wound in a ring shape placed around a wrist or an ankle by fastening both ends of the band together with fasteners made of plastics placed at both ends of a band body having a belt shape. Since this fastener is relatively expensive, there is a need to manufacture a wristband at lower cost.

There is a cheap wristband formed in a label type having an adhesive layer on a rear surface thereof without including the above fasteners. Both ends of this type band are adhered to each other. However, there is a problem that a user may intentionally peel off an adhesion portion of the wristband and thus one wristband may be reused by two or more users as an unauthorized use, for example, when a wristband, like one of label type, is used as tickets for an amusement center.

Of course, also in a medical field, there is a problem that the wristband, which was removed from a patient, could be mistakenly wrapped on an ankle or a wrist of other patients if the wristband once installed is used again.

In addition, there is a problem that it is difficult to fulfill the function of fracture for the reason that a notch portion formed on both ends for unauthorized use is not located at an adhesion portion (an overlapping portion), if both ends were not accurately, surely and carefully adhered along a predetermined length when both ends of a wristband of label type are adhered.

SUMMARY OF INVENTION

Technical Problem

The present invention has been made based on the above circumstances. It is an objective of the present invention to provide a wristband without the use of fasteners made of plastics, which can be produced at low cost in a structure in a label type.

It is another objective of the present invention to provide a wristband capable of preventing a patient from taking others' by mistake or unauthorized use.

It is another objective of the present invention to provide a wristband which because of fracture is difficult to return to an original state when an adhesion portion of the writstband is temporarily peeled off for the purpose of unauthorized use.

It is another objective of the present invention to provide a wristband, in which a fracturing notch used for preventing unauthorized use can be located at an adhesion portion (an overlapping portion) of both ends by securely and easily making a ring shape starting from a belt shape.

Solution to Problem

The present invention concerns a label wrapped around an object, like a wrist or ankle, or any other object and is focused on forming a fracturing notch in at least one of a first winding region and a second winding region. The regions are respectively located in the left and right ends of a printing region of the label in which specific information for indentifying a patient or a visitor is printed, and also forming an adhesion position check mark in at least one of a first winding region and a second winding region.

In an aspect of the present invention, a wristband comprises: a band base material in a belt shape; an adhesive layer formed on a rear surface of the band base material; and a mount temporarily attached to a rear surface of the adhesive layer. The band base material comprises: a printing region printable with specific information, a first winding region and a second winding region respectively located in the left and right ends of the printable region so as to be wound around a subject like a wrist or an ankle together with the printing area. At least one of the first winding region and the second winding region is formed with a fracturing notch. The adhesive layer is exposed when the mount located on the rear surface of the first winding region or the second winding region is peeled off. The exposed adhesive layer is adhered to the band base material side of the second winding region or the first winding region to form a ring shape winding on the wearer by overlapping each other. At least one of the first winding region and the second winding region is formed with an adhesion position check mark.

The fracturing notch may be located in an overlap region of the first winding region and the second winding region to form a ring shape.

The fracturing notch may have a plurality of cut lines along the length of the wristband.

The fracturing notch may be formed with a cut line having a tip portion in zigzag in a forward or reverse direction of the wristband.

The fracturing notch may be formed with a cut line extending in a width direction of at least one of the first winding region and the second winding region.

The mount may be formed with a cut line for peeling off the mount on the rear surface of the first winding region or the second winding region.

The fracturing notch may be formed in the vicinity of the adhesion position check mark.

The band base material band may be formed with a half-cut for removal.

The mount may be embossed to ensure breathability with no feeling of wrongness even when in direct contact with skin.

Advantageous Effects of Invention

In the wristband according to the present invention, a fracturing notch is formed in at least one of a first winding region and a second winding region respectively located in the left and right ends of a printable region in which specific information for indentifying a patient or a visitor is printed, and an adhesion position check mark is formed in at least one of a first winding region and a second winding region. Therefore, at least one of a first winding region and a second winding region having a fracturing notch can be adhered securely and easily to the other second winding region or first winding region by looking an adhesion position check mark. Then, it is difficult to peel off an adhesion portion while keeping the original state. A fracturing notch in an adhesion portion of the first winding region and the second winding region is fractured surely when an adhesion portion is peeled off for the purpose of unauthorized use, and thus unauthorized use should be prevented. It is thereby possible to avoid the errors during installation and removal of the wristband in the medical field.

DESCRIPTION OF EMBODIMENTS

The present invention provides a wristband capable of being prevented from unauthorized use. Since an adhesion position check mark is formed in at least one of a first winding region and a second winding region having a fracturing notch, at least one of the first winding region and the second winding region can be surely adhered to the other of the second winding region or the first winding region while looking at the region adhesion position check mark. Thus, the function of the fracturing notch in the overlapping region of the first winding region and the second winding region is surely fulfilled without having to pay much attention to operation in winding.

EXAMPLES

Figure 3:
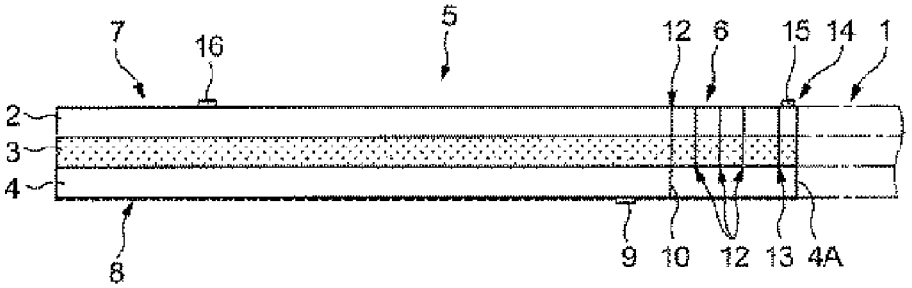
FIG. 3 is a cross sectional view in III-III line of FIG. 1.

Referring to FIGS. 1 to 8, is a wristband 1 according to an example of the present invention is described. In particular, as shown in FIG. 3, the wristband 1 comprises a band base material 2 in a belt shape, an adhesive layer 3 formed on a rear surface of the band base material 2, and a mount 4 temporarily attached to a rear surface of the adhesive layer 3.

The band base material 2 may be a synthetic paper which is based on, for example, polypropylene (PP), polystyrene (PS), polyethylene (PE) or the like, and mixed with or coated with a white pigment on its rear surface. Thus, by providing the base material 2 with opacity, and fitness for printing and smoothness, the band base material 2 is excellent for weather resistance, water resistance and printability. The band base material 2 has a printing region 5 located at the center extending substantially in a longitudinal direction thereof, and a first winding region 6 and a second winding region 7 located respectively in the left and right ends of the printing region 5.

The printing region 5 is printable with specific information to identify a patient or a visitor using bar codes or any other means such as characters or symbols, and further, if necessary, an IC chip (not shown) capable of storing much more information. The first winding region 6 and the second winding region 7 are possibly wound together with the printing region 5 around a subject W (FIGS. 5 and 6) such as a wrist or an ankle of a patient or a visitor.

The adhesive layer 3 may be of any type having adhesiveness or cohesiveness in a strength required, and preferably may be an ordinary paste or a strengthened paste.

A mount 4 is formed of a transparent material or the like, such as a relatively thin film and it has the strength required. The mount 4 is preferably formed with an embossed surface 8 on a rear surface thereof to ensure proper breathability with the skin even when that rear surface is in direct contact with skin, so that there is no uncomfortable feeling when installed. A position detection mark 9 (FIGS. 2 and 3) is printed in advance on the rear surface of the mount 4. When a continuous body of wristbands comprising a plurality of wristbands 1 successively disposed is installed in a printer (not shown) and transported toward the transport direction R (FIG. 1(1)) shown by arrow, the position detection mark 9 is detected using any sensor (not shown). Thus, above noted specific information, and the like, is possibly printed on a predetermined position in the printing region 5.

Further, a transverse peel-off cut line 10 is formed at a location along the axial direction of the wristband 1 on a boundary portion of the first winding region 6 in the rear surface of the mount 4 to enable peel off a peeling region 4A of the mount 4 on the rear surface of the second winding surface 7. Alternatively, the peel-off cut line 10 may be formed on a boundary portion of the second winding region 7 if the mount 4 on the rear surface of the second winding region 7 is removed. A peeling region 4A of the mount 4 on the rear surface of the first winding region 6 or the second winding region 7 can be peeled off to possibly expose the adhesive layer 3 of this winding region.

A fracturing notch 11 is formed in at least one of the first winding region 6 and the second winding region 7. In an example in the drawings a fracturing notch 11 is shown, formed in the first winding region 6. The notch portion 11 has, arrayed along the longitudinal direction of the wristband 1, a plurality of cut lines 12 in zigzag which cut lines extending in the width direction of the first winding region 6, which are relatively shorter.

Figure 1:
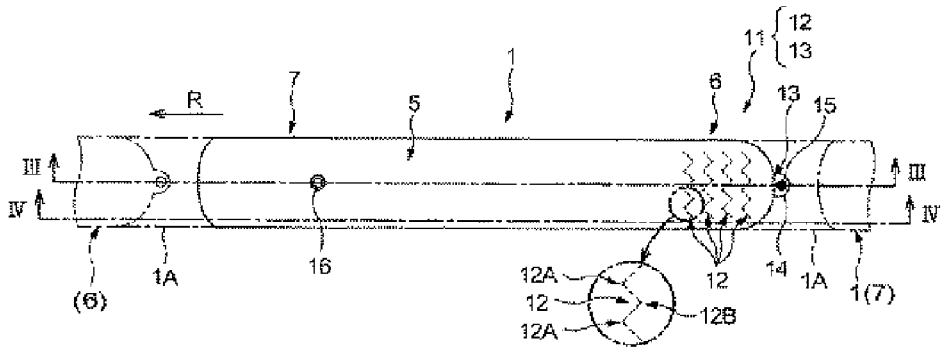
FIG. 1 is a plan view illustrating a wristband 1 according to an example of the present invention.
Figure 2:
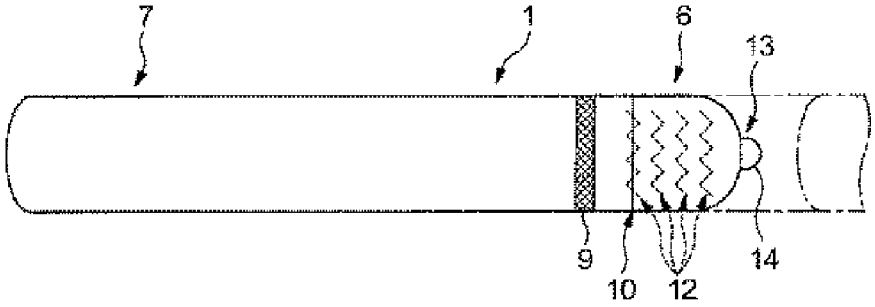
FIG. 2 is a rear view illustrating the wristband 1.

The cut line 12 in zigzag may be formed of perforations, full cut lines or any type of notch, which is difficult to break under a usual external force, but easy to break under an external force with which an adhesion portion of the first winding region 6 and the second winding region 7 is compulsorily peeled off. In addition, the cut line 12 in zigzag may also be formed towards the central portion of the band base material from a portion located inward slightly from both edges of the left and right ends of the first winding region 6, and in case of perforation and the like, an end portion may face the both edges of the left and right ends. In an enlarged view as shown in FIG. 1, however, in the cut line 12 in zigzag, preferably one of the notch tip portions 12A or apices of the zigzag is directed forward (for example, the transport direction R of the printer) of the wristband 1, and the other notch tip portion 12B is directed backward (the opposite direction from the transport direction R) of the wristband 1. It is desirable to provide the cut line 13 in the width direction and formed in perforation, since it is formed in a proximal end of a mark 14, as described below preferably, in a semicircular shape portion 14.

The mark 14 is in a semicircular shape and is formed protruding at the upstream end of the first winding region 6. The cut line 13 which extends in the width direction is formed at the proximal end of the mark and that line extends in the width direction of the first winding region 6.

A first adhesion position check mark 15 (an adhesion position check mark) in a circular shape is printed in advance in the center of the mark 14 in the first winding region 6. Therefore, the cut line 13 in the width direction, for the fracturing notch 11, is formed in the vicinity of the first adhesion position check mark 15. A second adhesion position check mark 16 (an adhesion position check mark) in a ring shape is formed in the second winding region 7 to act as an counterpart of the first adhesion position check mark 15.

Figure 5:
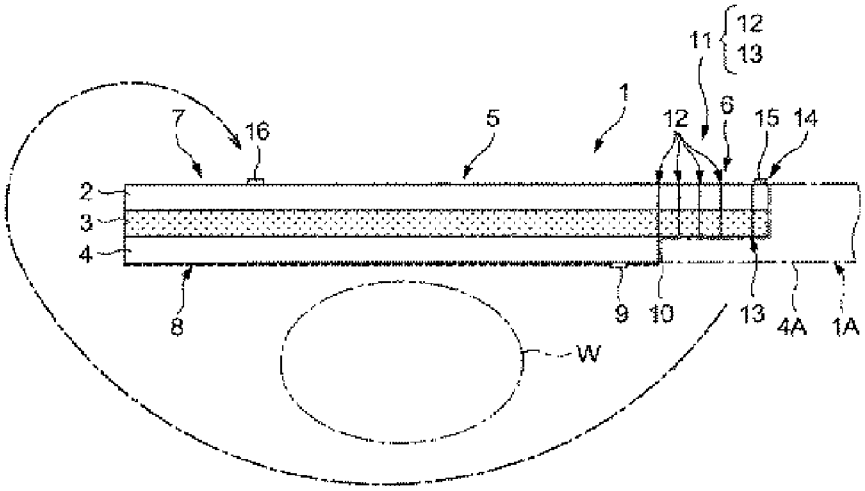
FIG. 5 is a cross sectional view illustrating a state where the wristband 1 in a belt shape is formed to the wristband 1 in a ring shape.
Figure 6:
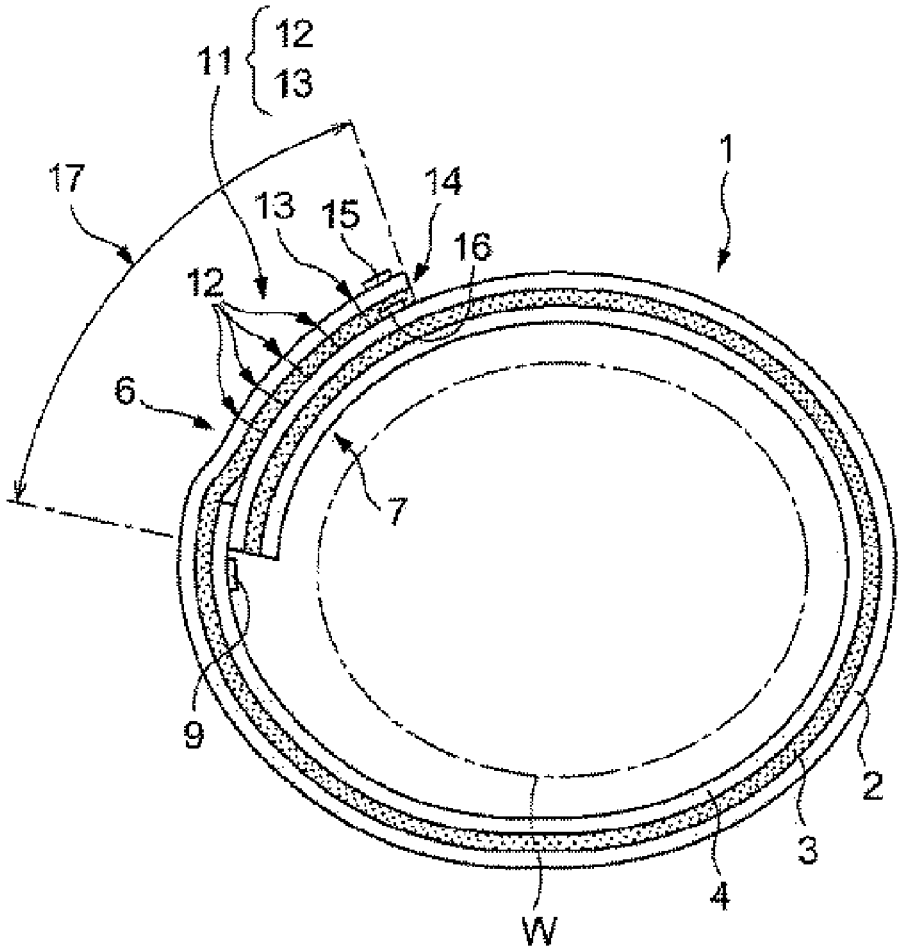
FIG. 6 is a cross sectional view illustrating a state where the wristband 1 in a ring shape is wound around a subject W.

FIG. 5 is a cross sectional view illustrating a state where the wristband 1 in a belt shape is formed to the wristband 1 in a ring shape. FIG. 6 is a cross sectional view illustrating a state where the wristband 1 is wound around a subject W in a ring shape. In addition, a cut for separation is not formed in the mount 4 in the coupling region 1A between another wristband 1 which is located upstream of the first winding region 6. The mount 4 in the coupling region 1A and the mount 4 (the peeling region 4A) in the rear surface of the first winding region 6 are mutually and successively integrated, and the coupling region 1A and the peeling region 4A can be easily peeled off from the wristband 1 (the first winding region 6) by peeling off the mark 14 of the first winding region 6 from the coupling region 1A.

As shown in FIG. 5, the peeling region 4A is peeled off and the adhesive layer 3 exposed in the rear surface of the first winding region is adhesively overlapped to the front surface of the band base material 2 in the second winding region 7 to constitute the overlapping region 17 (the adhesion region) and form a ring shape in such a way that it goes around the subject W. Thus, since the fracturing notch 11 is formed in the first winding region 6, and the wristband 1 in a belt shape is possibly formed into a ring shape (a closed circle) in such manner that the fracturing notch 11 is located in the overlapping region 17 of the first winding region 6 and the second winding region 7.

Figure 4:
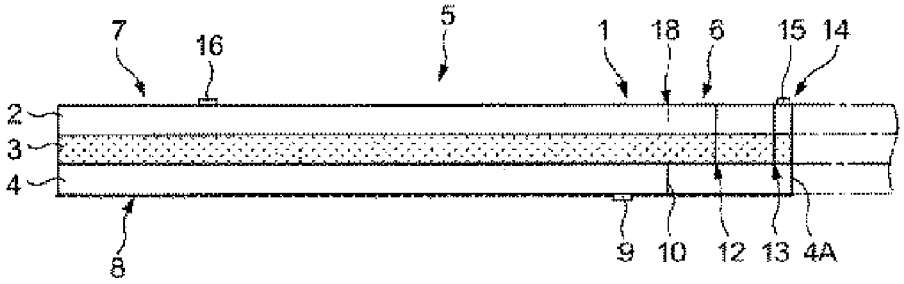
FIG. 4 is a cross sectional view in IV-IV line of FIG. 1.

Note that, as shown by the virtual leader line in FIG. 4, the band base material may be formed with a half cut 18 for removal to make it easier to break the wristband 1 as a proper process after finishing use thereof.

When using the wristband 1 as configured above, as shown in FIG. 6, the wristband 1 in a ring shape is attached to the subject W. As described above, the peeling region 4A of the mount 4 can be easily peeled off from a portion of the mark 14 in a semicircular shape in the first winding region with the connection region 1A of the wristband 1 located in the mark 14 side in a semicircular shape in the first winding region 6.

In a state that the adhesive layer 3 of the rear surface of the first winding region 6 is exposed, as shown in FIG. 5, if the first winding region 6 is adhered to the second winding region 7 so that the first adhesion position check mark 15 of the first winding region 6 is put together to the second adhesion position check mark 16 of the second winding region 7, the wristband 1 can easily attached to the subject W in a ring shape with not so much attention, as above, in a state where the fracturing notch 11 is securely located at the overlapping region of the first winding region 6 and the second winding region 7.

Figure 7:
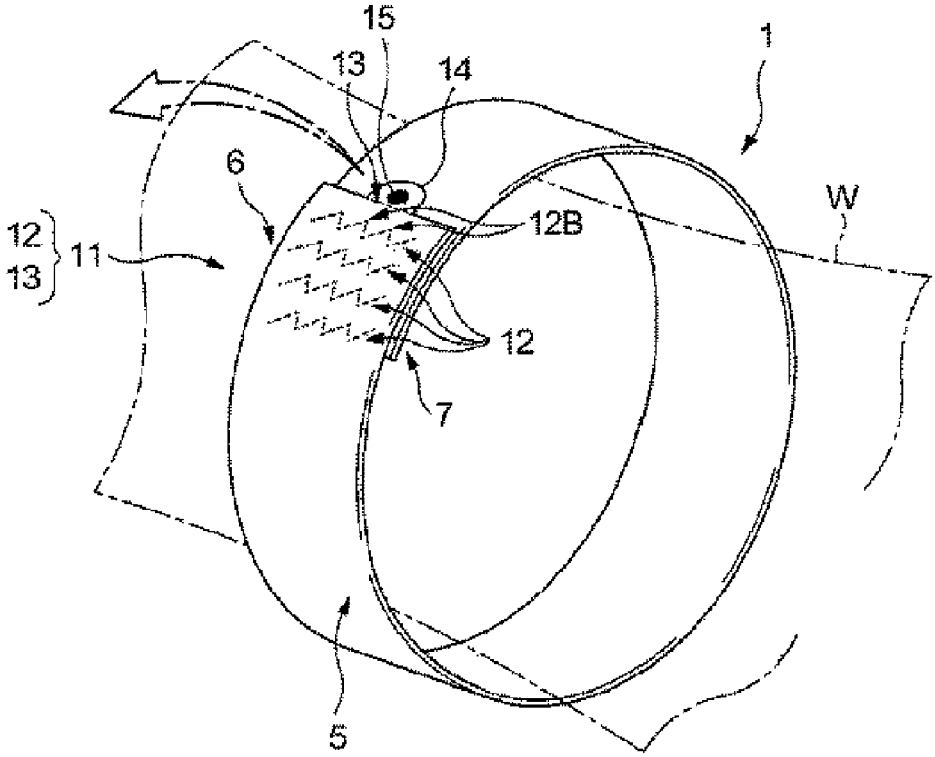
FIG. 7 is a perspective view illustrating a case where the wristband 1 is being removed from the subject W in a portion of a first winding region 6 or a mark 14 in a semicircle shape.

Described below is the where the wristband is removed in unauthorized way to reuse it. FIG. 7 is a perspective view illustrating a case where the wristband 1 is being removed from the subject W in a portion of a first winding region 6 or a mark 14 in a semicircle shape. Conversely, FIG. 8 is a perspective view illustrating a case where the wristband 1 is being removed from the subject W in a portion of second winding region 6.

As shown in FIG. 7, when trying to remove wristband from a portion thereof located in the first winding region 6 or from the mark 14 in a semicircular shape, the cut line 13 in the width direction (the fracturing notch 11) of the mark 14 is cut off easily, and the mark 14 is separated from the first winding region 6. It becomes thereafter difficult to return the wristband to the original state, and unauthorized use is prevented as a result. Even when the cut line 13 in the width direction is not cut off, the first winding region 6 is continuously removed from the second winding region 7 and the band base material 2 begins cutting from particularly the tip portion 12B of the cut line 12 along the zigzag, and it becomes similarly difficult to return the wristband to the original state and unauthorized use is prevented as a result.

Figure 8:
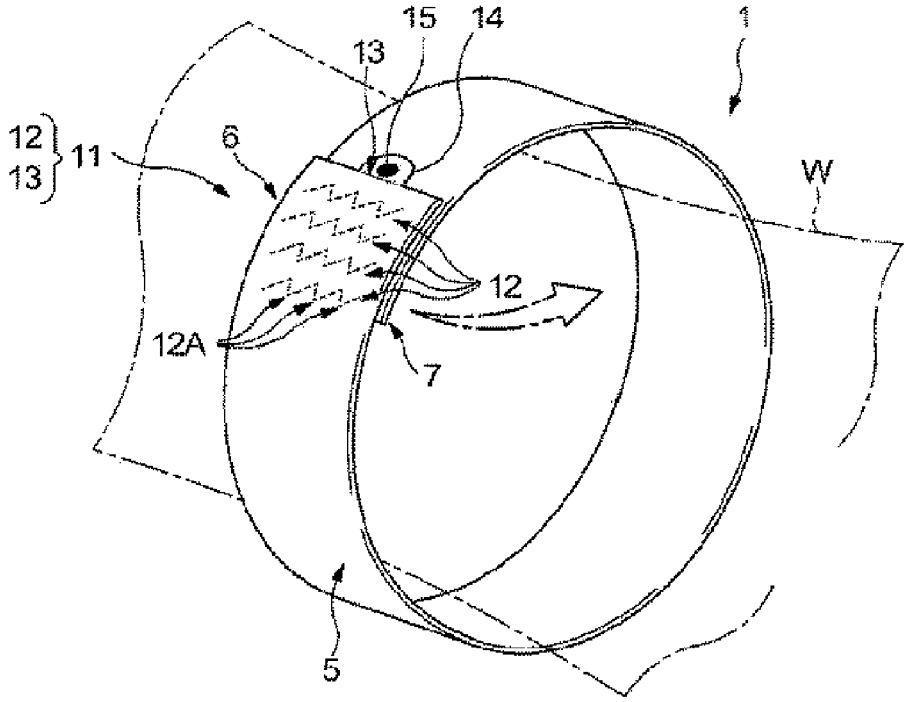
FIG. 8 is a perspective view illustrating a case where the wristband 1 is being removed from the subject W in a portion of second winding region 6.

As shown in FIG. 8, when trying to remove the band base material from a portion located in the second winding region 7, the band base material 2 begins cutting from particularly the tip portion 12A of the cut line 12 in zigzag and it becomes similarly difficult to return the wristband to the original state and unauthorized use is prevented as a result.

Thus, since it is possible to prevent unauthorized use, of course, and to produce the wristband 1 in the form of label at low cost, the wristband 1 can be discarded without reusing the issued wristband 1, even including in the medical field after removing the first winding region 6 or the second winding region 7 from the subject W.

The example described above, describes an example in which the fracturing notch 11 is formed in the first winding region 6. However, in the present invention, a fracturing notch 11 may be formed in the second winding region 7 and then the first winding region may be adhered to the second winding region 7 by removing the peeling region 4A of the mount 4 on the rear surface in the first winding region 6.

In addition, the form or the shape of the notch for fracture of the present invention is not limited to the example described above. Any type can be employed as long as a type which is difficult to return to the original state after fracture surely when an adhesion portion is temporarily peeled off for the purpose of unauthorized use. In addition, any type of an adhesion position check mark is also employed as long as the overlapping region 17 (an adhesion region) can be formed enough to the first winding region 6 and the second winding region 7.

The invention claimed is:

1. A wristband comprising:

a band base material in a belt shape having a first rear surface;

an adhesive layer formed on the first rear surface of the band base material, the adhesive layer having a second rear surface;

a mount temporarily attached to the second rear surface of the adhesive layer;

the band base material comprising:

a printing region printable thereon with specific information;

a first winding region and a second winding region located, respectively, at a left and a right end of the printing region, the winding regions are configured to be wound around a subject wrist or an ankle together with the printing area;

at least one of the first winding region and the second winding region including a fracturing region including at least one cut line that facilitates breaking and extends transverse to a longitudinal extent of the wristband, the at least one cut line comprising at least one of a perforation, a full cut line and a notch;

the mount is located on the adhesive layer of at least one of the first and second winding regions;

the adhesive layer is exposed when the mount located on the rear surface of the first winding region or the second winding region is peeled off the rear surface;

the exposed adhesive layer is adhered to the band base material side of the second winding region or the first winding region to form a ring shape winding on the subject wrist or ankle by overlapping each of the first and second winding regions; and at least one of the first winding region and the second winding region includes a protrusion comprising an adhesion position check mark positioned distal to the fracturing region and being free of any cut line, wherein the protrusion is distinct in shape from adjacent portions of the wristband, and provides a visual indication as to where to align the first winding region with the second winding region.

2. The wristband according to claim 1, wherein the fracturing region is located in an overlap region of the first winding region and the second winding region as the wristband forms a ring shape.

3. The wristband according to claim 2, wherein the fracturing region comprises a plurality of cut lines that each facilitate breaking and that extend across the wristband, the plurality of cut lines arrayed along the length of the wristband.

4. The wristband according to claim 2, wherein the cut line a zigzag with a tip portion in a forward and/or reverse direction along the wristband.

5. The wristband according to claim 2, wherein the cut line extends in a width direction across at least one of the first winding region and the second winding region.

6. The wristband according to claim 2, wherein the mount is formed with a second cut line located for enabling peeling off the mount from the rear surface of the first winding region or the second winding region.

7. The wristband according to claim 2, wherein the fracturing region is formed on the wristband adjacent the adhesion position check mark.

8. The wristband according to claim 1, wherein the band base material band is formed with a half-cut shaped and configured for enabling removal of the band base material.

* * * * *